US010260324B2

(12) United States Patent
Muraikhi et al.

(10) Patent No.: US 10,260,324 B2
(45) Date of Patent: Apr. 16, 2019

(54) DOWNHOLE SEPARATION EFFICIENCY TECHNOLOGY TO PRODUCE WELLS THROUGH A SINGLE STRING

(71) Applicant: Saudi Arabian Oil Company, Dhahran (SA)

(72) Inventors: Ahmad J. Muraikhi, Dhahran (SA); Ivan T. Cetkovic, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 136 days.

(21) Appl. No.: 15/335,668

(22) Filed: Oct. 27, 2016

(65) Prior Publication Data

US 2018/0003015 A1 Jan. 4, 2018

Related U.S. Application Data

(60) Provisional application No. 62/356,984, filed on Jun. 30, 2016.

(51) Int. Cl.
*E21B 43/12* (2006.01)
*E21B 43/38* (2006.01)

(52) U.S. Cl.
CPC ..... *E21B 43/128* (2013.01); *E21B 43/124* (2013.01); *E21B 43/38* (2013.01)

(58) Field of Classification Search
CPC ..... E21B 43/128; E21B 43/38; E21B 33/12; E21B 43/34; E21B 43/124; E21B 43/03; F04F 5/04
See application file for complete search history.

(56) References Cited

U.S. PATENT DOCUMENTS 5,482,117 A * 1/1996 Kolpak ..... E21B 43/121 166/105.5
5,525,146 A 6/1996 Straub
(Continued)

FOREIGN PATENT DOCUMENTS

GB 983644 A 2/1965
WO 00/75510 A2 12/2000

OTHER PUBLICATIONS

Carvalho, et al. "Modeling a Jet Pump with an electrical Submersible Pump for production of gassy petroleum wells." SPE Annual Technical Conference and Exhibition. Society of Petroleum Engineers, 1998. (pp. 1-13).
(Continued)

*Primary Examiner* — Michael R Wills, III
(74) *Attorney, Agent, or Firm* — Bracewell LLP; Constance G. Rhebergen; Linda L. Morgan

(57) ABSTRACT

Systems and method for producing hydrocarbons from a subterranean well include a combined product tubular extending into the well, a gas production tubular in fluid communication with the combined product tubular and a fluid production tubular in fluid communication with the combined product tubular. A jet pump is located a junction of the tubulars. An electrical submersible pump is in fluid communication with the fluid production tubular. A cyclone separator is located within the well and has a rotating screw with thread surfaces open to an inner diameter surface of the well. The thread surfaces are angled to direct a liquid stream axially downward and radially outward towards the inner diameter surface of the well, and to direct a gas stream to a lower end of the gas production tubular.

21 Claims, 4 Drawing Sheets

(56) References Cited

U.S. PATENT DOCUMENTS

| | | | | |
|---|---|---|---|---|
| 5,730,871 | A | 3/1998 | Kennedy et al. | |
| 6,080,312 | A | 6/2000 | Bowers et al. | |
| 6,113,675 | A * | 9/2000 | Branstetter | B01D 19/0052 95/261 |
| 6,131,655 | A | 10/2000 | Shaw | |
| 6,138,758 | A | 10/2000 | Shaw et al. | |
| 6,189,613 | B1 | 2/2001 | Chachula et al. | |
| 6,336,503 | B1 | 1/2002 | Alhanati et al. | |
| 6,357,530 | B1 | 3/2002 | Kennedy et al. | |
| 6,367,547 | B1 | 4/2002 | Towers et al. | |
| 6,394,183 | B1 * | 5/2002 | Schrenkel | B01D 21/2455 166/105.1 |
| 6,705,402 | B2 * | 3/2004 | Proctor | E21B 43/121 166/105.5 |
| 7,093,661 | B2 | 8/2006 | Olsen | |
| 8,607,877 | B2 | 12/2013 | Rodrigues | |
| 2004/0031608 | A1 | 2/2004 | Hall et al. | |
| 2012/0006543 | A1 | 1/2012 | Cox et al. | |
| 2013/0259721 | A1 * | 10/2013 | Noui-Mehidi | F04B 17/03 417/410.1 |
| 2014/0377080 | A1 | 12/2014 | Mao et al. | |

OTHER PUBLICATIONS

Castellanos, et al. "Analysis and Measurement Performance of an Axial Vortex Separator (AVS) for Liquid/Gas Mixture." Brasil Offshore. Society of Petroleum Engineers, 2011. (pp. 1-14).

FMC Technologies "CDS-Gasunie™ cyclone scrubber" www.fmctechnologies.com/separation (pp. 1-4).

Kouba, G. E., et al. "A review of gas-liquid cylindrical cyclone (glcc) technology." In Production Separation Systems International Conference, Aberdeen, England, Apr. 23-24. 1996. (pp. 1-25).

Mukherjee, et al. "Liquid holdup correlations for inclined two-phase flow." Journal of Petroleum Technology 35.05 (1983): pp. 1003-1008.

Patel et al. "Effective Down Hole gas-Liquid Separation to Eliminate Liquid Loading Problem in gas Wells." SPE Kuwait Oil and Gas Show and Conference. Society of Petroleum Engineers, 2013. (pp. 1-8).

Peirce, John William, et al. "Formation Powered Jet Pump Use at Kuparuk Field in Alaska." SPE Annual Technical Conference and Exhibition. Society of Petroleum Engineers, 2008. (pp. 1-12).

The International Search Report and Written Opinion for related PCT application PCT/US2017/040176 dated Oct. 16, 2017.

Baker Hughes and Centrilift, "Rotary Gas Separator", XP055412143, 2001, Claremore, OK USA.

* cited by examiner

DOWNHOLE SEPARATION EFFICIENCY TECHNOLOGY TO PRODUCE WELLS THROUGH A SINGLE STRING

CROSS REFERENCE TO RELATED APPLICATION

This application claims priority to and the benefit of U.S. Provisional Application Ser. No. 62/356,984, filed Jun. 30, 2016, titled "Downhole Separation Efficiency Technology To Produce Wells Through A Single String," the full disclosure of which is hereby incorporated herein by reference in its entirety for all purposes.

BACKGROUND OF THE DISCLOSURE

1. Field of the Disclosure

The disclosure relates generally to the development of wells with high gas oil ratio and high water cut, and more specifically to increase the downhole separation efficiency of the gas-liquid phase for producing through an electric submersible pump.

2. Description of the Related Art

One method of producing hydrocarbon fluid from a well bore that lacks sufficient internal pressure for natural production is to utilize an artificial lift method such as an electrical submersible pump. A string of tubing or pipe known as a production string suspends the submersible pumping device near the bottom of the well bore proximate to the producing formation. The submersible pumping device is operable to retrieve production zone fluid, impart a higher pressure into the fluid and discharge the pressurized production zone fluid into production tubing. Pressurized well bore fluid rises towards the surface motivated by difference in pressure.

In wells with high gas oil ratio or high water cut or having both high gas oil ratio and high water cut, there can be a decreased efficiency of the production of the hydrocarbons. The accumulation of gas in the electrical submersible pump can decrease the amount of fluids produced and cause gas locking of the pump. Gas locking can require a shut down of the pump, further harming fluid production of the well.

In some current systems, the gas phase is re-dissolved into the liquid phase in order to avoid a gas locking effect on the electrical submersible pump. This approach, however, sometimes cannot manage the amount of free gas in order to re-dissolve all of the free gas so the pump experiences a gas lock, reducing the production and increasing the probability of overheating and burning up the motor of the electrical submersible pump.

SUMMARY OF THE DISCLOSURE

Embodiments disclosed herein provide system and methods for improving the efficiency of the downhole separation of gas and liquids in order to produce hydrocarbons in wells that might not otherwise be able to produce hydrocarbons. Improving the gas-liquid separation in accordance with embodiments of this disclosure can prevent gas lock on the electrical submersible pump. Systems and methods of this disclosure can increase the downhole separation efficiency of the gas-liquid phase in order to produce the liquid phase through an electrical submersible pump. The downhole separation efficiency technology is in the form of a cyclone separator of the embodiments described herein. The gas phase is re-injected into the liquid phase downstream of the electrical submersible pump through a jet pump to produce the combined product to the surface.

In an embodiment of this disclosure, a system for producing hydrocarbons from a subterranean well includes a combined product tubular extending into the well, a gas production tubular in fluid communication with the combined product tubular, and a fluid production tubular in fluid communication with the combined product tubular. A jet pump is located a junction of the gas production tubular, the fluid production tubular, and the combined product tubular. An electrical submersible pump is in fluid communication with the fluid production tubular. A cyclone separator is located within the well. The cyclone separator has a rotating screw with thread surfaces open to an inner diameter surface of the well, the thread surfaces angled to direct a liquid stream axially downward and radially outward towards the inner diameter surface of the well. The thread surfaces of the rotating screw are also angled to direct a gas stream to a lower end of the gas production tubular.

In alternate embodiments the thread surfaces of the rotating screw can be angled to direct the gas stream axially downward and radially inward, relative to the liquid stream. A packer can be located within the well downstream of the cyclone separator and the combined product tubular can extend through the packer. The cyclone separator can be located within the well adjacent to perforations into a subterranean formation or alternately located lower than a lateral bore of the well.

In other alternate embodiments of this disclosure, the electrical submersible pump can be located axially lower in the well than the cyclone separator. The electrical submersible pump can be operable to draw the liquid stream from the inner diameter surface of the well and direct the liquid stream into the fluid production tubular. The inner diameter surface of the well can be an inner diameter surface of a well casing. The jet pump can be oriented to inject the gas stream into the liquid stream.

In another embodiment of this disclosure, a system for producing hydrocarbons from a subterranean well includes a combined product tubular extending into the well and through a packer that fluidly seals across a casing of the well. A gas production tubular is in fluid communication with the combined product tubular and a fluid production tubular is also in fluid communication with the combined product tubular. An electrical submersible pump is in fluid communication with the fluid production tubular. A cyclone separator is within the well. The cyclone separator has a rotating screw with thread surfaces open to an inner diameter surface of the casing. The thread surfaces are angled to direct a liquid stream radially outward towards the inner diameter surface of the casing and to direct a gas stream radially inward relative to the liquid stream. The thread surfaces of the rotating screw are also angled to direct the gas stream towards a lower end of the gas production tubular. A jet pump is located at a junction of the gas production tubular, the fluid production tubular, and the combined product tubular, the jet pump powered by the liquid stream and oriented to inject the gas stream into the liquid stream.

In alternate embodiments, the electrical submersible pump can be located axially lower in the well than the cyclone separator. The electrical submersible pump can be located within the well axially lower than a lateral bore of the well and the packer can be located within the well axially above the lateral bore. The electrical submersible pump can be operable to draw the liquid stream from the inner diameter surface of the casing and direct the liquid stream into the fluid production tubular. The jet pump can be operable to direct the liquid stream from the fluid production tubular and direct the gas stream from the gas production tubular into the combined product tubular.

In yet another alternate embodiment of this disclosure, a method for producing hydrocarbons from a subterranean well include extending a combined product tubular into the well. A gas production tubular and a fluid production tubular are extending into the well, each of the gas production tubular and the fluid production tubular being in fluid communication with the combined product tubular. A jet pump is located at a junction of the gas production tubular, the fluid production tubular, and the combined product tubular. An electrical submersible pump is provided in fluid communication with the fluid production tubular. A cyclone separator is provided within the well, the cyclone separator having a rotating screw with thread surfaces open to an inner diameter surface of the well. The cyclone separator is operated so that the thread surfaces direct a liquid stream axially downward and radially outward towards the inner diameter surface of the well and direct a gas stream to a lower end of the gas production tubular.

In alternate embodiments, the gas stream can be directed axially downward and radially inward relative to the liquid stream with the thread surfaces of the rotating screw. A portion of the well can be sealed with a packer located within the well downstream of the cyclone separator and the combined product tubular can extend through the packer. The cyclone separator can be located adjacent to perforations into a subterranean formation and the electrical submersible pump can be located axially lower than a lateral bore of the well.

In other alternate embodiments, the electrical submersible pump can be operated to draw the liquid stream from the inner diameter surface of the well and can direct the liquid stream into the fluid production tubular. The jet pump can be operated to direct the liquid stream from the fluid production tubular and the gas stream from the gas production tubular into the combined product tubular.

BRIEF DESCRIPTION OF THE DRAWINGS

So that the manner in which the above-recited features, aspects and advantages of the embodiments of this disclosure, as well as others that will become apparent, are attained and can be understood in detail, a more particular description of the disclosure briefly summarized above may be had by reference to the embodiments thereof that are illustrated in the drawings that form a part of this specification. It is to be noted, however, that the appended drawings illustrate only preferred embodiments of the disclosure and are, therefore, not to be considered limiting of the disclosure's scope, for the disclosure may admit to other equally effective embodiments.

DETAILED DESCRIPTION

Embodiments of the present disclosure will now be described more fully hereinafter with reference to the accompanying drawings which illustrate embodiments of the disclosure. Systems and methods of this disclosure may, however, be embodied in many different forms and should not be construed as limited to the illustrated embodiments set forth herein. Rather, these embodiments are provided so that this disclosure will be thorough and complete, and will fully convey the scope of the disclosure to those skilled in the art. Like numbers refer to like elements throughout, and the prime notation, if used, indicates similar elements in alternative embodiments or positions.

In the following discussion, numerous specific details are set forth to provide a thorough understanding of the present disclosure. However, it will be obvious to those skilled in the art that embodiments of the present disclosure can be practiced without such specific details. Additionally, for the most part, details concerning well drilling, reservoir testing, well completion and the like have been omitted inasmuch as such details are not considered necessary to obtain a complete understanding of the present disclosure, and are considered to be within the skills of persons skilled in the relevant art.

Figure 1:
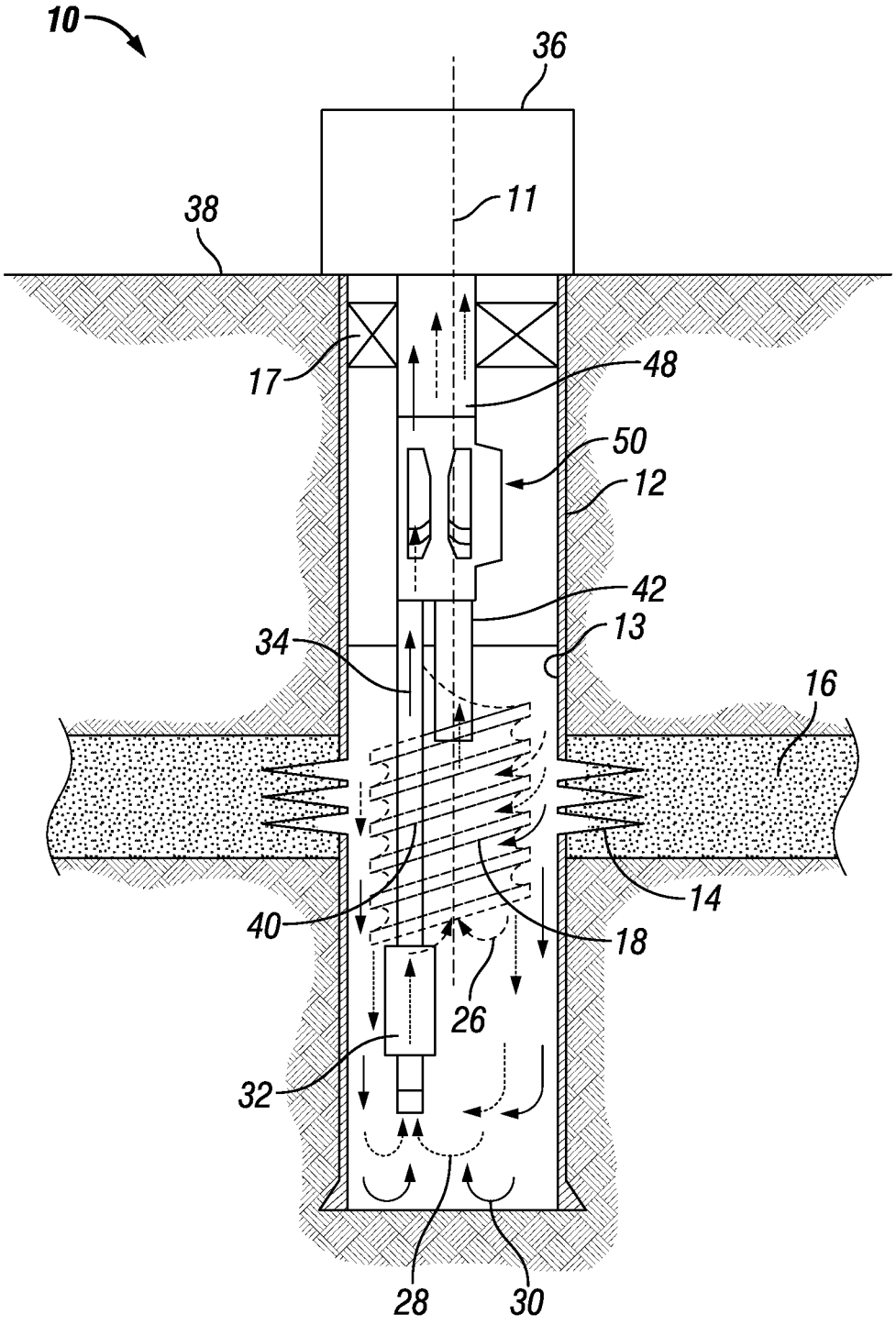
FIG. 1 is a schematic section view of a system for producing hydrocarbons from a subterranean well, in accordance with an embodiment of this disclosure.
Figure 2:
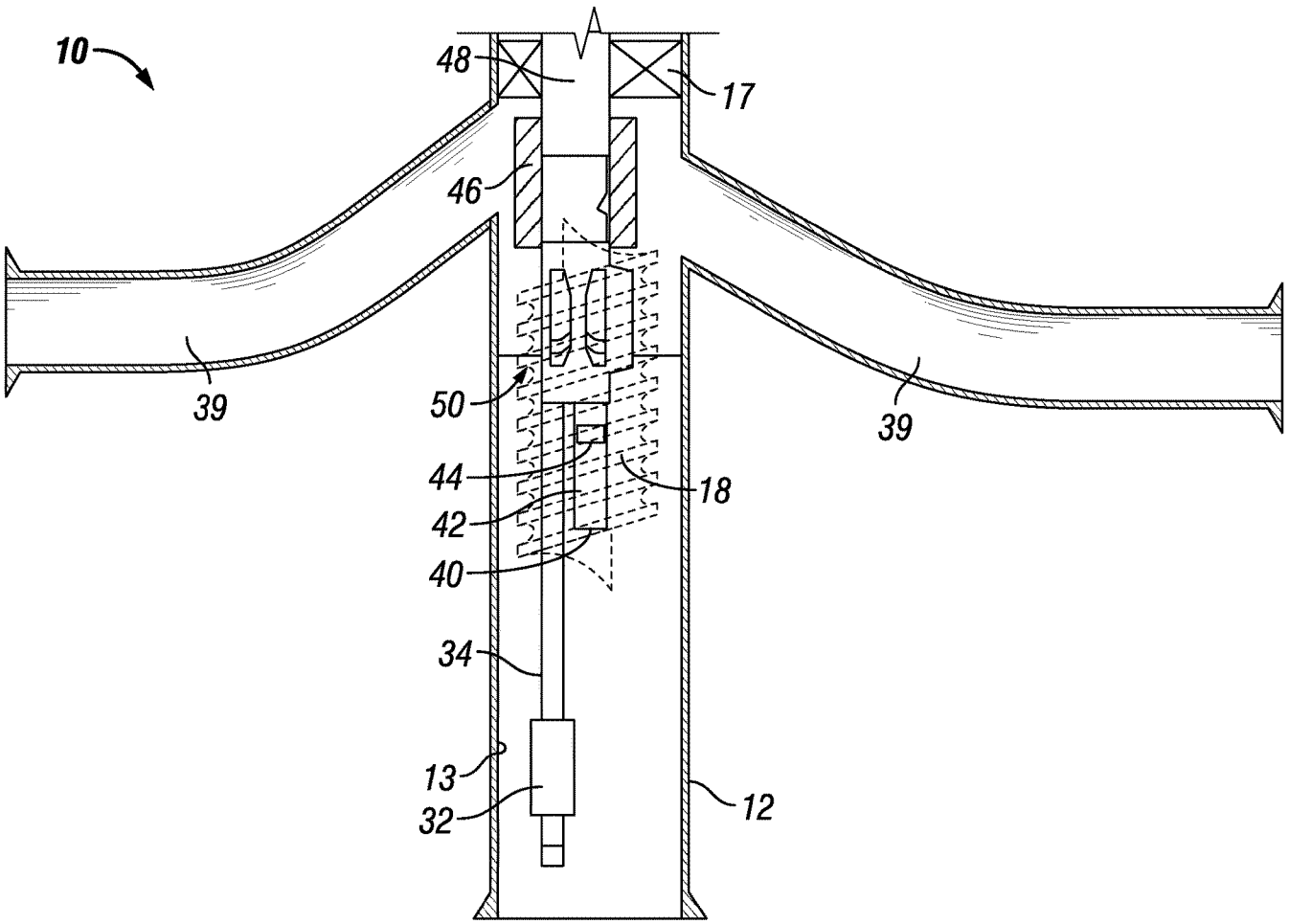
FIG. 2 is a schematic section view of a system for producing hydrocarbons from a multilateral subterranean well, in accordance with an embodiment of this disclosure.

Looking at FIG. 1, well 10 is a subterranean well used in hydrocarbon production operations. Well 10 can be lined with cement and casing 12 in a manner known in the art. Well 10 can have a central axis 11. Well 10 can be a vertical well, as shown, or can be angled or slanted, horizontal, or can be a multilateral well (FIG. 2). Regardless of the orientation of well 10, central axis 11 will follow a center line through well 10. Well 10 can have an inner diameter surface 13. Inner diameter surface 13 of well 10 can be the inner diameter surface of casing 12. Perforations 14 can extend through casing 12 and into subterranean formation 16. Formation 16 can contain a combination of liquid and gaseous hydrocarbons and water, which pass through perforations 14 and into well 10 as a multiphase production fluid. Packer 17 can extend across well 10, fluidly sealing across well 10 downstream of perforations 14. Packer 17 fluidly seals a portion of well 10 that includes perforations 14 from a downstream portion of well 10. Where well 10 is a vertical or generally vertical well, packer 17 is axially above perforations 14.

In certain hydrocarbon developments, there may be a high gas oil ratio, that is, there may be a significant amount of hydrocarbon gasses compared to liquid hydrocarbon. The gas can be dissolved in the liquid hydrocarbon, or oil. The gas oil ratio (GOR) can be known as the volume of gas relative to the volume of crude oil that is produced. Because the volume of gas will change with a change in temperature or pressure, GOR is given at standard temperature and pressure conditions. Over time as a formation 16 is drained, the GOR can increase until the well can no longer be effectively produced efficiently with some current technology. In the hydrocarbon development, there may additionally or alternately be a high water cut (WCT). Water cut can be known as the ratio of water produced to the volume of total liquid produced.

In the example embodiment of FIG. 1, as the production fluid enters well 10, it is drawn into cyclone separator 18. Cyclone separator 18 is located within well 10 adjacent to perforations 14. Cyclone separator 18 can be located in an annulus between casing 12 and tubular members located within well 10, such as production tubular 34. Cyclone separator 18 will bring the multiphase flow that enters well 10 from formation 16 into rotation where the centrifugal forces will act on the production fluid. Looking at FIGS. 1-3, cyclone separator 18 includes rotating screw 20 with thread surfaces 22 open to inner diameter surface 13 of well 10. That is, cyclone separator 18 does not have an external shroud or housing but rotating screw 20 is instead located directly in well 10. As rotating screw 20 rotates, centrifugal forces will separate the liquid stream of the production fluid from the gas stream 26 of the production fluid. The liquid stream includes a liquid hydrocarbon such as oil component 28 and a water component 30.

Thread surfaces 22 are helical shaped protrusion that wind around rotating screw 20. Thread surfaces 22 are oriented such that a liquid stream of the production fluid to move radially outward and axially downward as rotating screw 20 rotates. Thread surfaces 22 are also oriented such that gas stream 26 of the production fluid moves radially inward, relative to the liquid stream, and axially downward as rotating screw 20 rotates.

The liquid stream in the form of oil component 28 and a water component 30 will travel downward along the helical path of thread surfaces 22, between adjacent thread surfaces 22. As the liquid stream moves axially downward, it will also move radially outward. When sufficient centrifugal force has acted on the liquid stream, the liquid stream will leave rotating screw 20 and move radially outward of rotating screw 20 towards inner diameter surface 13 of well 10. The liquid stream can leave rotating screw 20 at a bottom end of rotating screw 20 or at another axial location along rotating screw 20. Because rotating screw 20 does not have a shroud or housing, the liquid stream can contact inner diameter surface 13. After the liquid stream has moved radially outward of rotating screw 20, the liquid stream will continue to move axially downward within well 10. In embodiments, the liquid stream will form a film on inner diameter surface 13 of well 10 and move axially downward within well 10 along inner diameter surface 13 of well 10.

Looking at FIGS. 1-2, electrical submersible pump (ESP) 32 is located at an end of fluid production tubular 34 and is in fluid communication with fluid production tubular 34. Fluid production tubular 34 extends into well 10. Fluid production tubular 34 is indirectly in fluid communication with wellhead assembly 36. Fluid production tubular 34 extends through packer 17. Rotating screw 20 has an outer diameter that allows for rotating screw 20 to be positioned alongside fluid production tubular 34 within well 10.

Wellhead assembly 36 can be located at an earth's surface 38 above well 10. ESP 32 is located axially lower in well 10 than perforations 14 into subterranean formation 16 and axially lower in well 10 than cyclone separator 18. In embodiments with one or more lateral bores 39, ESP 32 is also located axially lower in well 10 than one or more of the lateral bores 39. In the example embodiment of FIG. 2, there are two lateral bores 39 and ESP 32 is located axially lower in well 10 than both of the lateral bores 39. Therefore production fluids will pass through cyclone separator 18 before the liquid stream reaches ESP 32 and the liquid stream portion of production fluids that reaches ESP 32 will have significantly less gas than the production fluids that entered well 10 through perforations 14. This will reduce the risk of gas lock in ESP 32 and increase the efficiency of ESP 32.

ESP 32 is operable to draw the liquid stream from within well 10, including from inner diameter surface 13 of well 10, and direct the liquid stream into fluid production tubular 34. ESP 32 will provide sufficient lift to the liquid stream to deliver the liquid stream to wellhead assembly 36 through fluid production tubular 34.

Gas stream 26 can travel axially downward along the helical path of thread surfaces 22, between adjacent thread surfaces 22. When gas stream 26 reaches a bottom end of rotating screw 20, gas stream 26 will be directed towards lower end 40 of gas production tubular 42. Gas production tubular 42 extends into well 10. Gas production tubular 42 is indirectly in fluid communication with wellhead assembly 36. Lower end 40 of gas production tubular 42 is axially lower in well 10 than perforations 14. Therefore production fluids will pass through cyclone separator 18 before gas stream 26 reaches gas production tubular 42 and the gas stream 26 portion of production fluids that reaches gas production tubular 42 will have significantly less liquid than the production fluids that entered well 10 through perforations 14.

Looking at FIG. 2, in certain embodiments, mist capturing devices can be included, such as demister 44 and vanes 46. Demister 44 is shown located within gas production tubular 42 for capturing mist of gas stream 26. Vanes 46 are located on an outer surface of combined product tubular 48 axially below packer 17. Vanes 46 utilize the principles of momentum, gravity and coalescing in order to achieve high separation performance with low pressure drop. The gas phase of the production fluid is subjected to multiple changes in direction as it flows through vane passages. The entrained liquid droplets are forced to contact vane walls where they impinge and form a film. After this first separation the production fluid enters into the cyclone separator 18 in order to improve the gas-liquid separation.

Looking at FIGS. 1-2, jet pump 50 is located a junction of gas production tubular 42, fluid production tubular 34, and combined product tubular 48. Jet pump 50 directs the liquid stream from fluid production tubular 34 and gas stream 26 from gas production tubular 42 into combined product tubular 48. Combined product tubular 48 extends into well 10 through packer 17 and carries the produced fluids to wellhead assembly 36. Jet pump 50 provides for the reinjection of gas stream 26 into the liquid stream. After the phases are mixed the multiphase flow is produce to surface through combined product tubular 48.

In operation, jet pump 50 is powered by the liquid stream and oriented to inject gas stream 26 into the liquid stream. As the liquid stream passes through a nozzle of jet pump 50, a low pressure region is created which draws gas stream 26 into jet pump 50. The multiphase flow is then directed into combined product tubular 48 with sufficient pressure to be delivered to wellhead assembly 36.

In order to confirm the performance of the systems and method described herein, multiphase modeling of various operation conditions were developed. Looking at Table 1, the operations conditions used in the modeling are shown. Table 2 sets for the results of the modeling in terms of the pressures and gas volume fraction obtained for the listed operating conditions. In Tables 1-2, the following data is included:

- Rate=flow of production fluids in barrels per day (BPD).
- WCT=water cut shown as the ratio of water produced to the volume of total liquid produced.
- GOR (and GOR rate)=gas oil ratio shown as the volume of gas in standard cubic feet (SCF) relative to the volume of crude oil in barrels (STB) that is produced.
- Qo Rate or Oil Rate=flow of oil in barrels per day (BOPD).

Qw Rate or Water Rate=flow of water in barrels per day (BWPD).

WCT Rate=flow of water in barrels per day divided by the sum of the flow of oil in barrels per day plus the flow of water in barrels per day shown as a percentage.

Ql Rate or Liquid Rate=flow of total liquids in barrels per day (BWPD).

Qg Rate or Gas Rate=flow of gas in million standard cubic feet per day (MMSCFD).

Downhole Sep Liq/Gas Phase=the amount of liquid in the gas stream, given as a percentage.

Downhole Gas Liq/Phase=the amount of gas in the liquid stream, given as a percentage.

PIP ESP=pump-intake pressure in pounds per square inch gage (psig).

PDP ESP=pump discharge pressure in pounds per square inch gage (psig).

GVF=the ratio of the gas volumetric flow rate to the total volumetric flow rate, shown as a percentage.

FBHP=flowing bottom hole pressure in pounds per square inch gage (psig).

Holdup=the fraction of liquid present in an interval of the gas string, shown as a percentage of overall fluid in the interval of the gas string.

Jet Pump HP Pressure=pressure at the inlet of the jet pump in pounds per square inch gage (psig).

Jet Pump LP Pressure=pressure at the outlet of the jet pump in pounds per square inch gage (psig).

Jet Pump D Pressure=pressure at the diffuser in pounds per square inch gage (psig).

The ESP string is fluid production tubular 34 and the gas string is gas production tubular 42.

TABLE 2

Different Operational Conditions

| | | ESP STRING | | |
|---|---|---|---|---|
| RATE BPD | WCT % | PIP-ESP PSIG | PDP-ESP PSIG | GVF % |
| MED | LOW | 1,753 | 2,798 | 1.1% |
| | | 1,763 | 2,810 | 2.0% |
| | | 1,704 | 2,708 | 5.0% |
| | MED | 1,837 | 2,914 | 2.4% |
| | | 1,705 | 2,678 | 11.7% |
| | | 1,387 | 2,062 | 41.5% |
| HIGH | MED | 1,929 | 3,083 | 1.5% |
| | | 1,936 | 2,792 | 12.5% |
| | | 1,752 | 2,420 | 32.3% |
| | MED | 1,912 | 2,936 | 7.4% |
| | | 1,816 | 2,440 | 36.1% |
| | | 1,872 | 2,243 | 55.9% |
| | HIGH | 1,646 | 3,449 | 5.9% |
| | | 1,630 | 3,012 | 28.1% |
| | | 1,787 | 2,673 | 48.6% |

TABLE 1

Different Operational Conditions

| | | | RATES | | | | | | DOWNHOLE SEP EFF | | |
|---|---|---|---|---|---|---|---|---|---|---|---|
| RATE BPD | WCT % | GOR SCF/STB | Qo BOPD | Qw BWPD | WCT % | QL BWPD | Qg MMSCFD | GOR SCF/STB | Downhole Sep Liq/Gas Phase | Downhole Sep Gas/Liq Phase | Downhole Sep Efficiency |
| MED | LOW | LOW | 2,000 | 222 | 10% | 2,222 | 1.41 | 703 | 10% | 10% | High |
| | | | 2,000 | 222 | 10% | 2,222 | 1.41 | 703 | 25% | 35% | Medium |
| | | | 2,000 | 222 | 10% | 2,222 | 1.41 | 703 | 50% | 70% | Low |
| | MED | MED | 2,000 | 667 | 25% | 2,667 | 3.00 | 1,500 | 10% | 10% | High |
| | | | 2,000 | 667 | 25% | 2,667 | 3.00 | 1,500 | 25% | 35% | Medium |
| | | | 2,000 | 667 | 25% | 2,667 | 3.00 | 1,500 | 50% | 70% | Low |
| HIGH | MED | MED | 4,000 | 1,333 | 25% | 5,333 | 6.00 | 1,500 | 10% | 10% | High |
| | | | 4,000 | 1,333 | 25% | 5,333 | 6.00 | 1,500 | 25% | 35% | Medium |
| | | | 4,000 | 1,333 | 25% | 5,333 | 6.00 | 1,500 | 50% | 70% | Low |
| | MED | MED | 4,000 | 1,333 | 25% | 5,333 | 12.00 | 3,000 | 10% | 10% | High |
| | | | 4,000 | 1,333 | 25% | 5,333 | 12.00 | 3,000 | 25% | 35% | Medium |
| | | | 4,000 | 1,333 | 25% | 5,333 | 12.00 | 3,000 | 50% | 70% | Low |
| | HIGH | HIGH | 4,000 | 4,000 | 50% | 8,000 | 12.00 | 3,000 | 10% | 10% | High |
| | | | 4,000 | 4,000 | 50% | 8,000 | 12.00 | 3,000 | 25% | 35% | Medium |
| | | | 4,000 | 4,000 | 50% | 8,000 | 12.00 | 3,000 | 50% | 70% | Low |

TABLE 3

| Jet Pump Operational Conditions | | | | | | | | | |
|---|---|---|---|---|---|---|---|---|---|
| Operational Conditions | | | | | | | Jet Pump Design Data | | |
| Oil Rate BPD | GOR SCF/BPD | WCT % | FBHP PSIG | Water Rate BPD | Gas Rate MMSCFD | Liquid Rate BPD | HP Pressure PSIG | LP Pressure PSIG | D Pressure PSIG |
| 2,000 | 703 | 10% | 2,701 | 200 | 1.41 | 2,200 | 3,400 | 1,972 | 2,700 |
| 2,000 | 1,500 | 25% | 2,215 | 500 | 3.00 | 2,500 | 2,480 | 1,993 | 2,215 |
| 2,000 | 3,000 | 25% | 1,782 | 500 | 6.00 | 2,500 | 2,000 | 1,681 | 1,781 |
| 2,000 | 3,000 | 50% | 2,091 | 1,000 | 6.00 | 3,000 | 2,351 | 1,950 | 2,091 |
| 4,000 | 703 | 10% | 2,711 | 400 | 2.81 | 4,400 | 3,400 | 1,995 | 2,711 |
| 4,000 | 1,500 | 25% | 2,230 | 1,000 | 6.00 | 5,000 | 2,550 | 1,962 | 2,230 |
| 4,000 | 3,000 | 25% | 1,773 | 1,000 | 12.00 | 5,000 | 2,000 | 1,671 | 1,774 |
| 4,000 | 3,000 | 50% | 2,155 | 2,000 | 12.00 | 6,000 | 2,450 | 1,996 | 2,155 |
| 6,000 | 703 | 10% | 2,750 | 600 | 4.22 | 6,600 | 3,500 | 1,970 | 2,750 |
| 6,000 | 1,500 | 25% | 2,296 | 1,500 | 9.00 | 7,500 | 2,650 | 2,000 | 2,296 |
| 6,000 | 3,000 | 25% | 1,944 | 1,500 | 18.00 | 7,500 | 2,520 | 1,681 | 1,944 |
| 6,000 | 3,000 | 50% | 2,456 | 3,000 | 18.00 | 9,000 | 3,300 | 2,000 | 2,456 |

As can be seen in Table 1 and Table 2, with a low downhole separation efficiency there are instances where the ESP string will not be able to produce fluids to the surface. Having tested cyclone separator 18 at the surface, it was found that the efficiency of cyclone separator 18 can be high relative to current technologies, and in the range of 81% to 93%. The operational conditions of the jet pump are shown in Table 3.

Figure 3:
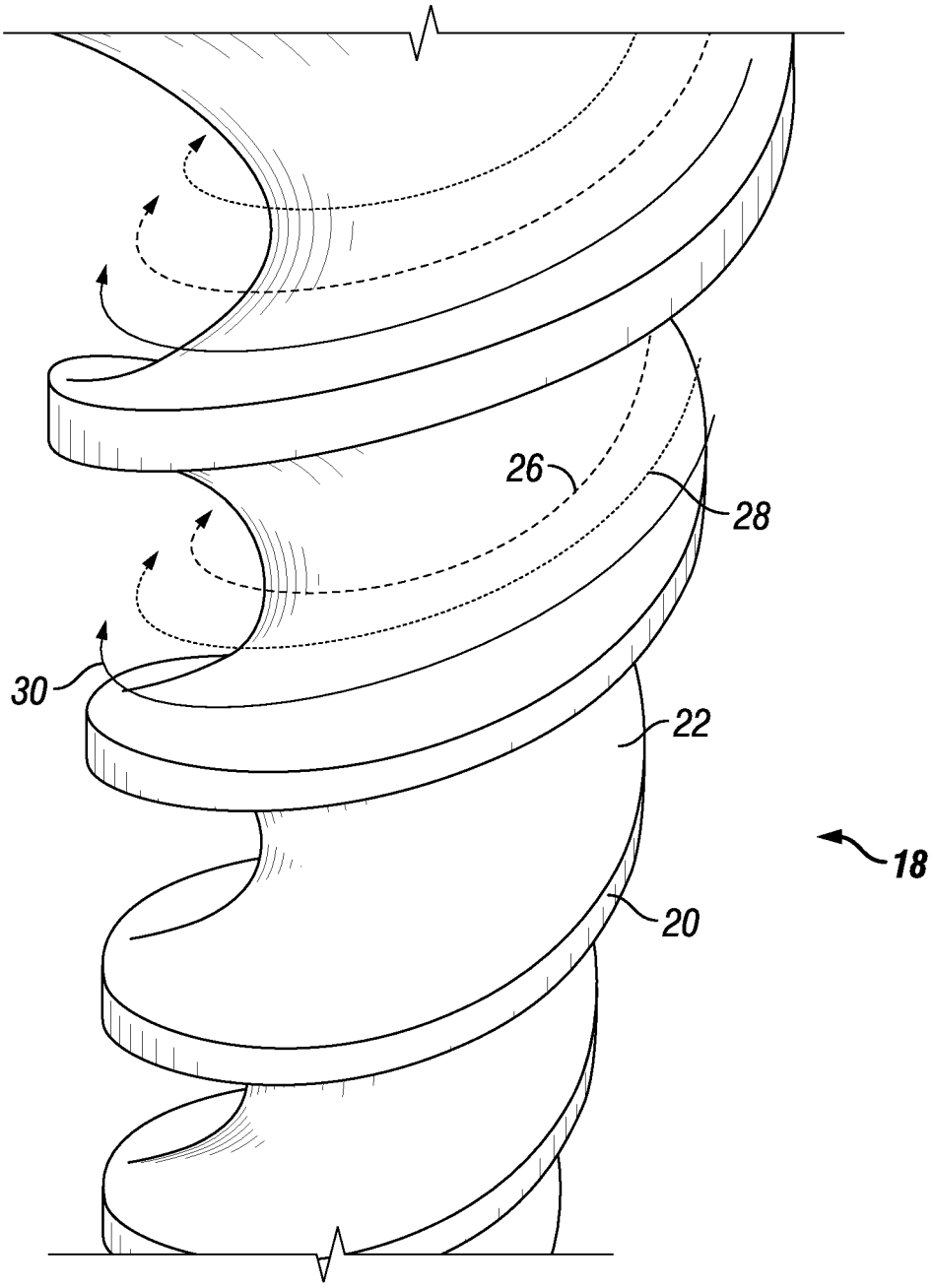
FIG. 3 is a section view of a portion of a cyclone separator in accordance with an embodiment of this disclosure.
Figure 4:
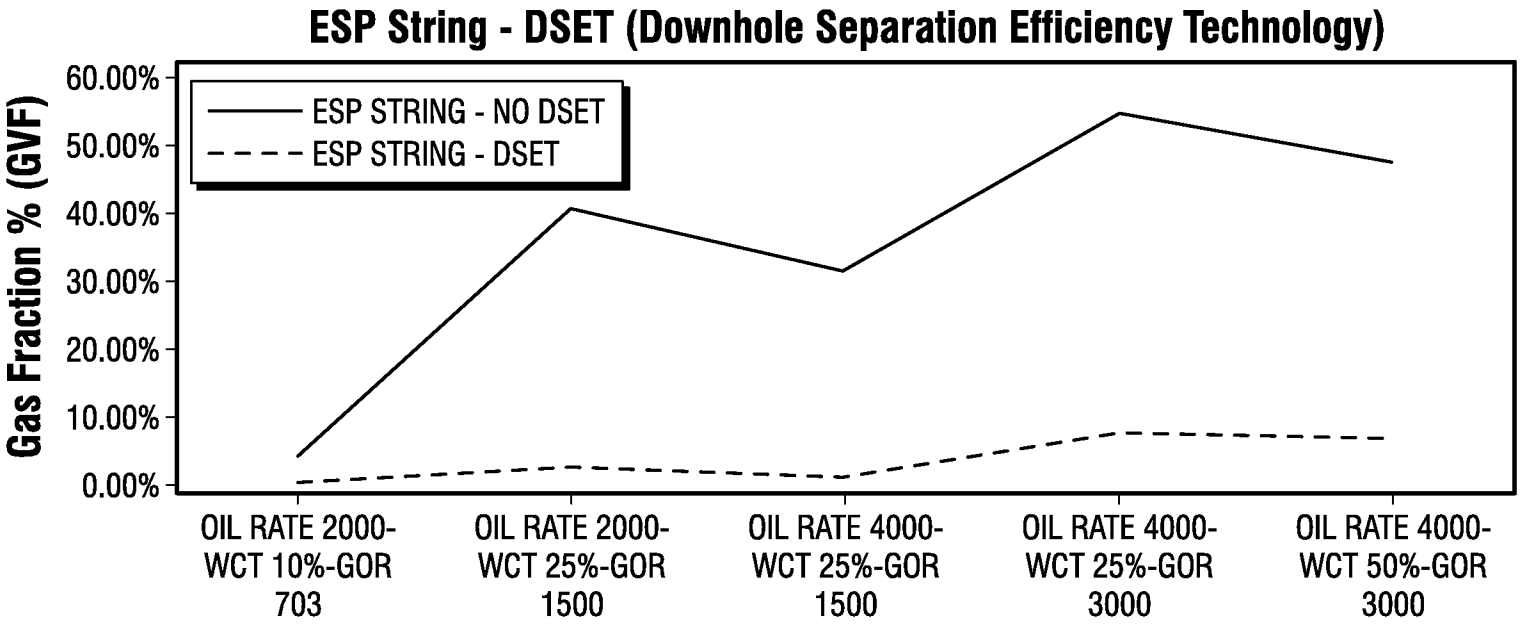
FIG. 4 is a graph comparing the GVF of the ESP string from a model operating condition to the GVF in the ESP string that could be obtained using embodiments of the cyclone separator disclosed herein.

Looking at FIG. 3, results of the GVF of the ESP string from Table 2 are compared to the GVF in the ESP string that could be obtained using embodiments of the cyclone separator 18 disclosed herein. With the efficiency of cyclone separator 18, the GVF of the fluids passing through ESP 32 are significantly reduced and ESP 32 can operate without gas lock and more efficiently compared to the example model.

Therefore, as disclosed herein, embodiments of the systems and methods of this disclosure will increase oil and gas production, maintaining the hydrocarbon supply with a higher production rate per well. Hydrocarbon recovery can be expedited, especially for high GOR wells and wells with high WCT. Using the systems and methods disclosed herein, wells with high surface network backpressure can be produced and the frequency of ESP failures can be reduced.

Embodiments of the disclosure described herein, therefore, are well adapted to carry out the objects and attain the ends and advantages mentioned, as well as others inherent therein. While a presently preferred embodiment of the disclosure has been given for purposes of disclosure, numerous changes exist in the details of procedures for accomplishing the desired results. These and other similar modifications will readily suggest themselves to those skilled in the art, and are intended to be encompassed within the spirit of the present disclosure and the scope of the appended claims.

What is claimed is:

1. A system for producing hydrocarbons from a subterranean well, the system comprising:

a combined product tubular extending into the well;

a gas production tubular in fluid communication with the combined product tubular;

a fluid production tubular in fluid communication with the combined product tubular;

a jet pump located a junction of the gas production tubular, the fluid production tubular, and the combined product tubular;

an electrical submersible pump in fluid communication with the fluid production tubular;

a cyclone separator within the well, the cyclone separator having:

a screw having a helical pattern of thread surfaces open to an inner diameter surface of the well, the screw having a maximum outer diameter spaced radially inward and spaced apart from an inner diameter surface of the well and the thread surfaces angled so that the screw is operable to direct a liquid stream axially downward and radially outward towards the inner diameter surface of the well to form a film on the inner diameter surface of the well and move axially downhole within the well along the inner diameter surface of the well; and wherein the thread surfaces of the helical pattern of the screw are angled to direct a gas stream to a lower end of the gas production tubular.

2. The system of claim 1, wherein the thread surfaces of the helical pattern of the screw are angled to direct the gas stream axially downward and radially inward, relative to the liquid stream.

3. The system of claim 1, further comprising a packer located within the well downstream of the cyclone separator, wherein the combined product tubular extends through the packer.

4. The system of claim 1, wherein the cyclone separator is located within the well adjacent to perforations into a subterranean formation.

5. The system of claim 1, wherein the cyclone separator is located within the well axially lower than a lateral bore of the well.

6. The system of claim 1, wherein the electrical submersible pump is located axially lower in the well than the cyclone separator.

7. The system of claim 1, wherein the electrical submersible pump is operable to draw the liquid stream from the inner diameter surface of the well and direct the liquid stream into the fluid production tubular.

8. The system of claim 1, wherein the inner diameter surface of the well is an inner diameter surface of a well casing.

9. The system of claim 1, wherein the jet pump is oriented to inject the gas stream into the liquid stream.

10. A system for producing hydrocarbons from a subterranean well, the system comprising:

a combined product tubular extending into the well and through a packer that fluidly seals across a casing of the well;

a gas production tubular in fluid communication with the combined product tubular;

a fluid production tubular in fluid communication with the combined product tubular;

an electrical submersible pump in fluid communication with the fluid production tubular;

a cyclone separator within the well, the cyclone separator having:

a screw having a helical pattern of thread surfaces open to an inner diameter surface of the casing, the screw having a maximum outer diameter spaced radially inward and spaced apart from the inner diameter surface of the casing, the thread surfaces angled to direct a liquid stream radially outward towards the inner diameter surface of the casing to form a film on the inner diameter surface of the casing and move axially downhole within the well along the inner diameter surface of the casing and to direct a gas stream radially inward relative to the liquid stream; and wherein the thread surfaces of the screw are angled to direct the gas stream towards a lower end of the gas production tubular; and a jet pump located at a junction of the gas production tubular, the fluid production tubular, and the combined product tubular, the jet pump powered by the liquid stream and oriented to inject the gas stream into the liquid stream.

11. The system of claim 10, wherein the electrical submersible pump is located axially lower in the well than the cyclone separator.

12. The system of claim 10, wherein the electrical submersible pump is located within the well axially lower than a lateral bore of the well and the packer is located within the well axially above the lateral bore.

13. The system of claim 10, wherein the electrical submersible pump is operable to draw the liquid stream from the inner diameter surface of the casing and direct the liquid stream into the fluid production tubular.

14. The system of claim 10, wherein the jet pump is operable to direct the liquid stream from the fluid production tubular and the gas stream from the gas production tubular into the combined product tubular.

15. A method for producing hydrocarbons from a subterranean well, the method comprising:

extending a combined product tubular into the well;

extending a gas production tubular and a fluid production tubular into the well, each of the gas production tubular and the fluid production tubular being in fluid communication with the combined product tubular;

locating a jet pump at a junction of the gas production tubular, the fluid production tubular, and the combined product tubular;

providing an electrical submersible pump in fluid communication with the fluid production tubular;

providing a cyclone separator within the well, the cyclone separator having a screw having a helical pattern of thread surfaces open to an inner diameter surface of the well, the screw further having a maximum outer diameter spaced radially inward and spaced apart from an inner diameter surface of the well; and operating the cyclone separator so that the thread surfaces direct a liquid stream axially downward and radially outward towards the inner diameter surface of the well to form a film on the inner diameter surface of the well and move axially downhole within the well along the inner diameter surface of the well and direct a gas stream to a lower end of the gas production tubular.

16. The method of claim 15, further comprising directing the gas stream axially downward and radially inward relative to the liquid stream with the helical pattern of thread surfaces of the screw.

17. The method of claim 15, further comprising sealing a portion of the well with a packer located within the well downstream of the cyclone separator, wherein the combined product tubular extends through the packer.

18. The method of claim 15, further comprising locating the cyclone separator adjacent to perforations into a subterranean formation.

19. The method of claim 15, further comprising locating the electrical submersible pump axially lower than a lateral bore of the well.

20. The method of claim 15, further comprising operating the electrical submersible pump to draw the liquid stream from the inner diameter surface of the well and direct the liquid stream into the fluid production tubular.

21. The method of claim 15, further comprising operating the jet pump to direct the liquid stream from the fluid production tubular and the gas stream from the gas production tubular into the combined product tubular.

* * * * *